US005764191A

United States Patent [19]

Tsuda

[11] Patent Number: 5,764,191

[45] Date of Patent: Jun. 9, 1998

[54] RETRACTABLE ANTENNA ASSEMBLY FOR A PORTABLE RADIO DEVICE

[75] Inventor: Shinichiro Tsuda, San Diego, Calif.

[73] Assignees: Sony Corporation, Tokyo, Japan; Sony Electronics Inc., Park Ridge, N.J.

[21] Appl. No.: 729,705

[22] Filed: Oct. 7, 1996

[51] Int. Cl.[6] ..... H01Q 1/24

[52] U.S. Cl. ..... 343/702; 343/895; 343/900

[58] Field of Search ..... 343/702, 715, 343/749, 895, 900, 901, 903; H01Q 1/24, 1/36

[56] References Cited

U.S. PATENT DOCUMENTS

| | | | |
|---|---|---|---|
| 5,469,177 | 11/1995 | Rush et al. | 343/895 |
| 5,504,494 | 4/1996 | Chatzipetros et al. | 343/895 |
| 5,548,827 | 8/1996 | Hanawa et al. | 343/895 |
| 5,612,704 | 3/1997 | Cole | 343/895 |

FOREIGN PATENT DOCUMENTS

| | | | |
|---|---|---|---|
| 0716469 A1 | 6/1996 | European Pat. Off. | H01Q 1/24 |
| 0755091 A1 | 1/1997 | European Pat. Off. | H01Q 9/32 |

*Primary Examiner*—Donald T. Hajec
*Assistant Examiner*—Tho Phan
*Attorney, Agent, or Firm*—Pasquale Masacchio, Esq.; Jerry A. Miller

[57] ABSTRACT

An antenna assembly according to the present invention has a rod antenna movable between a retracted position and an extended position, a helical antenna having a plurality of helical portions which are electrically separated from one another. The rod antenna extends through the inside of the helical antenna when the rod antenna is in the extended position and the rod antenna is removed from the inside of the helical antenna when the rod antenna is in the retracted position. The antenna assembly also includes connecting metal piece for electrically connecting the plurality of helical portions when the rod antenna is in the retracted position so that the plurality of helical portions become operable as a single helical antenna.

11 Claims, 12 Drawing Sheets

RETRACTABLE ANTENNA ASSEMBLY FOR A PORTABLE RADIO DEVICE

BACKGROUND OF THE INVENTION

This invention relates to an antenna assembly, and more particularly to an antenna assembly suitable for use in a compact portable radio apparatus such as a cellular phone.

In recent years, portable radio apparatuses have been reduced in size and weight. Accordingly, antenna assemblies used for such portable radio apparatuses are also required to be smaller. As an antenna assembly which satisfies the above requirements, many manufacturers are developing whip antennas which can be retracted into the housing body when the apparatus is not used for communications. The whip antenna is pulled out of the housing to be extending therefrom when the apparatus is used for communications. Portable radio apparatuses in an early stage have utilized this type of whip antenna which is relatively simple.

Such a whip antenna, when extending from the housing body, is operative as a monopole antenna. However, when the antenna is in a retracted position in the housing body, it cannot obtain a sufficient gain because the antenna retracted in the housing body is placed near the ground so that it causes an input impedance to increase, whereby impedance matching can be hardly established.

Thus, to improve the gain of the antenna when retracted in the housing body, a whip antenna of a so-called top loading type came into use instead of the simple whip antenna described above. The top loading type whip antenna comprises a helical antenna electrically connected to the top end of a rod antenna. When this type of whip antenna extends from the housing body for use, radio waves can be radiated from both of the helical antenna and the rod antenna. When the antenna is retracted into the housing body, radio waves can be radiated from the helical antenna.

However, this type of whip antenna includes the rod antenna which does not contribute to the radiation of radio waves when it is retracted. This portion operates as an open stub. The open stub affects input impedance of the antenna. Especially, the open stub causes disturbance of delicate impedance matching, depending upon the distance between the rod antenna and circuit boards in the housing. Besides, if a shield is not complete, signals are undesirably input through the rod antenna in a retracted position and signals go into the inside of the shield.

Because of these problems of the whip antenna, another type of antenna assembly has been developed, in which a rod antenna, when retracted into the housing body, is electrically isolated from a helical antenna. An example of such an antenna assembly will be described with reference to FIGS. 1A to 2B.

FIGS. 1A and 1B show an example of a conventional retractable antenna assembly in an extended position and in a retracted position, respectively. As shown in FIGS. 1A and 1B, a retractable antenna assembly has a fixed antenna part including helical antenna 201 and a movable antenna part including rod antenna 301. The fixed antenna part comprises helical antenna 201, first metal fitting 202 having a first snap-in recess inside thereof for the extended position, second metal fitting 203 for fixing helical antenna 201 onto first metal fixing 202, and antenna cover 205 for covering helical antenna 201 and preventing a human body from touching helical antenna 201. Antenna cover 205 has second snap-in recess 204 for the retracted position.

The movable antenna part comprises rod antenna 301 which is a monopole antenna, antenna cover 302 for covering rod antenna 301 and preventing a human body from touching rod antenna 301, and metal stopper 303 attached to the lower end of rod antenna 301. Metal stopper 303 has a first snap-in protrusion which engages the first snap-in recess of metal fitting 202 when the antenna assembly is in the extended position as shown in FIG. 1A. Knob 304 for retracting and extending the movable antenna part is provided at the upper end of antenna cover 302. Knob 304 is also effective in preventing the movable antenna part from falling into housing 101. Second snap-in protrusion 305 is also provided right below knob 304 of antenna cover 302 to engage second snap-in recess 204 when the antenna assembly is in the retracted position as shown in FIG. 1B.

The antenna assembly is mounted on housing 101 of a mobile radio unit by screwing metal fitting 202 into metal fitting 102 which has been attached to housing 101. After the antenna assembly is so mounted on housing 101, helical antenna 201 is always powered from power supply circuit 104 through antenna clip 103 for electrical connection between a signal line extending from power supply circuit 104 and metal fitting 102, and metal fittings 202 and 203. On the other hand, rod antenna 301 is powered only when the antenna assembly is in the extended position where metal stopper 303 contacts metal fittings 202 and 102. The power supply to rod antenna 301 in the extended position is made from power supply circuit 104 through antenna clip 103, metal fitting 102, metal fitting 202 and metal stopper 303.

When the antenna assembly is in the extended position as shown in FIG. 1A, rod antenna 301 extends through the inside of helical antenna 201. Not only helical antenna 201 but also rod antenna 301 are powered through metal stopper 303 which contacts metal fittings 102 and 202. In this state, rod antenna 301 mainly operates as a monopole antenna which has its ground level at the ground of a shielding case inside housing 101 of the mobile radio unit and the ground of circuit board 105. Although helical antenna 201 is also powered, it is operable as an accessory of rod antenna 301.

When the antenna assembly is in the retracted position as shown in FIG. 1B, rod antenna 301 has no electrical connection with metal fittings 102 and 202. In addition, there is provided a certain space between the upper portion of rod antenna 301 and the lower portion of helical antenna 201 including metal fittings 102 and 202 in order to avoid the electromagnetical coupling between helical antenna 201 and rod antenna 301. Therefore, rod antenna 301 has no effect on the antenna performance in the retracted position. Therefore, helical antenna 201 operates as a single helical antenna which has its ground level at the ground of the shielding case inside housing 101 of the mobile radio unit and the ground of circuit board 105.

FIGS. 2A and 2B show another example of a conventional retractable antenna assembly in an extended position and in a retracted position, respectively. A basic structure of this antenna assembly is similar to that of the antenna assembly shown in FIGS. 1A and 1B.

In the retracted position as shown in FIG. 2B, rod antenna 301 has no electrical connection with metal fittings 102 and 202. In addition, there is provided a certain space between the upper portion of rod antenna 301 and the lower portion of helical antenna 201 including metal fittings 102 and 202 in order to avoid the electromagnetical coupling between helical antenna 201 and rod antenna 301. Rod antenna 301 has no effect on the antenna performance in the retracted position. Therefore, helical antenna 201 operates as a single helical antenna which has its ground level at the ground of the shielding case inside housing 101 of the mobile radio unit and the ground of circuit board 105. A principle of the above operation in the retracted position is exactly same as that of the antenna assembly shown in FIGS. 1A and 1B.

The only difference between the antenna assembly shown in FIGS. 1A and 1B and the antenna assembly shown in FIGS. 2A and 2B is a stopper attached to the lower end of rod antenna 301. Unlike metal stopper 301 as shown in FIGS. 1A and 1B, insulator stopper 307 is used in the antenna assembly shown in FIGS. 2A and 2B. In the extended position, even though insulator stopper 307 contacts metal fittings 102 and 202, there is no electrical connection between helical antenna 201 and rod antenna 301 because insulator stopper 307 exists therebetween. Nevertheless, rod antenna 301 is powered by electromagnetical coupling between helical antenna 201 and rod antenna 301. As a result, in the extended position, rod antenna 301 mainly operates as a monopole antenna which has its ground level at the ground of the shielding case inside housing 101 of the mobile radio unit and the ground of circuit board 105. Although helical antenna 201 is also powered, it is operable as an accessory of rod antenna 301.

With this structure of retractable antenna assemblies shown in FIGS. 1A to 2B, the helical antenna enables the mobile radio unit to receive an incoming call even in the retracted position, and by extending the rod antenna, the performance of the antenna is improved for actual communication.

In these retractable antenna assemblies, antenna lengths in extended and retracted positions are designed based on a wavelength of the required frequency band (1.9 GHz, for example). More specifically, the length of the helical antenna is designed in light of the requirement for the antenna length in the retracted position and the length of the rod antenna is designed in light of the requirement for the antenna length in the extended position. The rod antenna and the helical antenna which have been so designed are supposed to achieve the best antenna performance in the required frequency band.

However, there is another factor to be considered in designing the antenna lengths. At such a high frequency as 1.9 GHz, undesirable resonance owing to the electromagnetic coupling between the rod antenna (monopole antenna) and helical antenna is likely to occur in the extended position where the rod antenna extends through the inside of the helical antenna. In some cases, this undesirable resonance may be produced around a frequency close to the required frequency band so that it degrades the performance of the monopole antenna.

In order to move the undesirable resonance away from the required frequency band, the helical antenna parameters such as length, pitch and turn number could be modified. However, this kind of modification of the helical antenna to avoid the undesirable resonance would necessarily change the helical antenna condition which has been optimized to the best performance in the retracted position. With such a modification to avoid the undesirable resonance, the performance of the helical antenna in retracted position can no longer be the best. On the other hand, without such a modification, the undesirable resonance would degrade the antenna performance in the extended position. In other words, the requirement to optimize the helical antenna performance in the retracted position sometimes conflicts with the requirement to avoid the undesirable resonance produced in the extended position.

SUMMARY OF THE INVENTION

Accordingly, it is one object of the present invention to provide an antenna assembly having a rod antenna (monopole antenna) and a helical antenna which are optimized to the desirable performance, both in extended and retracted positions. The antenna assembly also has an improved flexibility in designing each antenna.

In accordance with the present invention, there is provided an antenna assembly having a rod antenna movable between a retracted position and an extended position, a helical antenna having a plurality of helical portions which are electrically separated from one another. The rod antenna extends through the inside of the helical antenna when the rod antenna is in the extended position and the rod antenna is removed from the inside of the helical antenna when the rod antenna is in the retracted position. The antenna assembly further includes connecting metal piece for electrically connecting the plurality of helical portions when the rod antenna is in the retracted position so that the plurality of helical portions become operable as a single helical antenna.

DESCRIPTION OF THE PREFERRED EMBODIMENTS

Figure 1A:
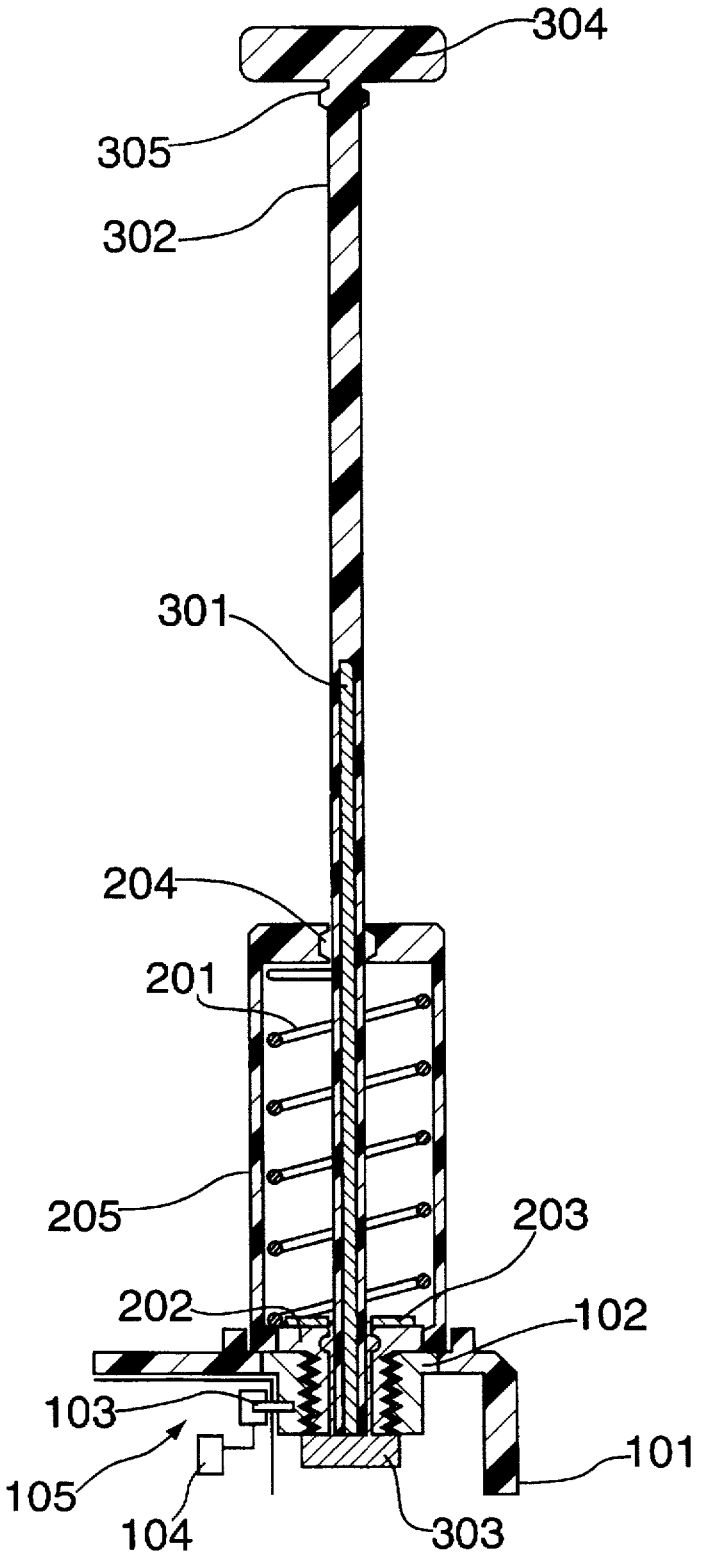
FIG. 1A PRIOR ART
FIG. 1A shows a conventional antenna assembly in an extended position.
Figure 1B:
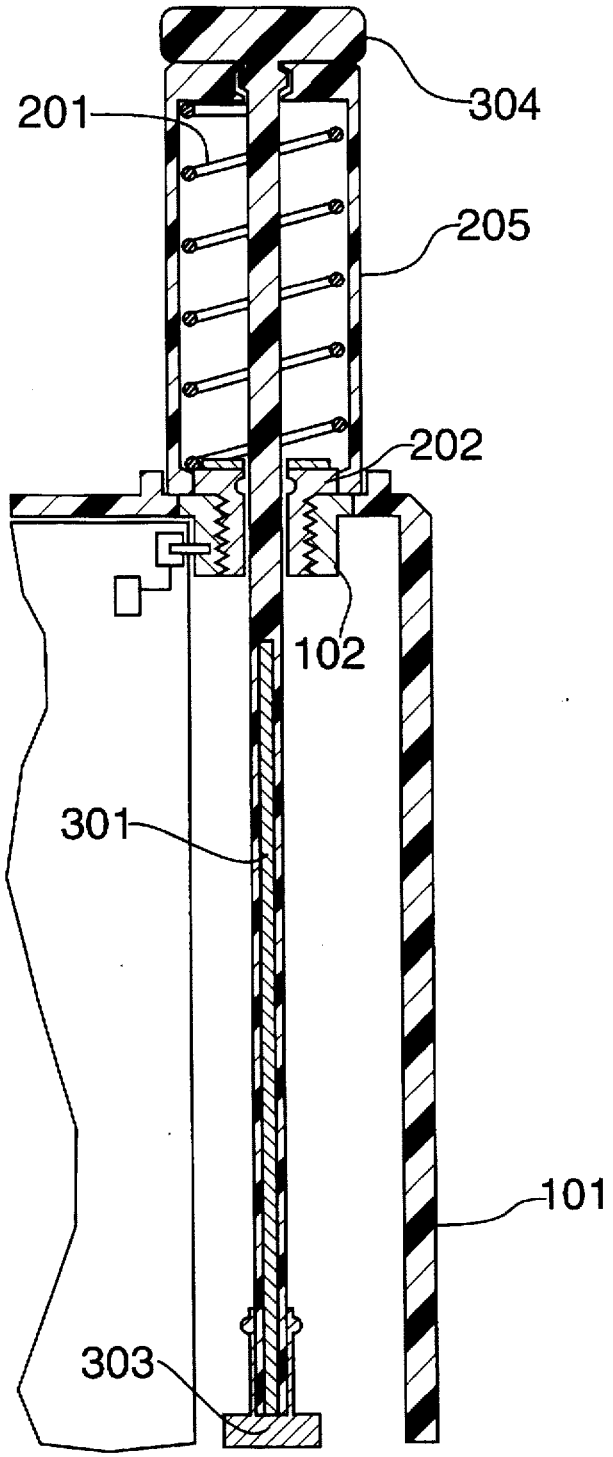
FIG. 1B PRIOR ART
FIG. 1B shows a conventional antenna assembly in a retracted position.
Figure 2A:
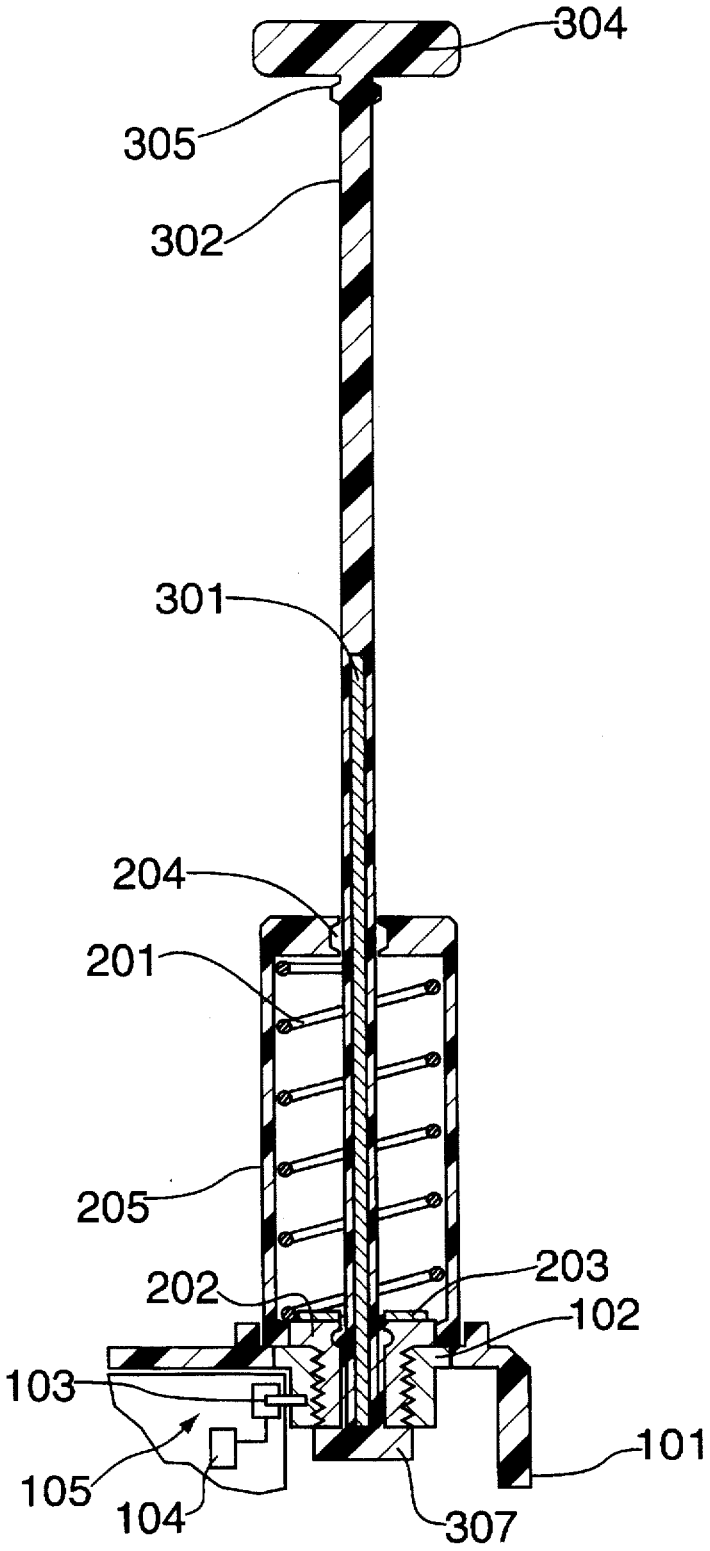
FIG. 2A PRIOR ART
FIG. 2A shows another conventional antenna assembly in an extended position.
Figure 2B:
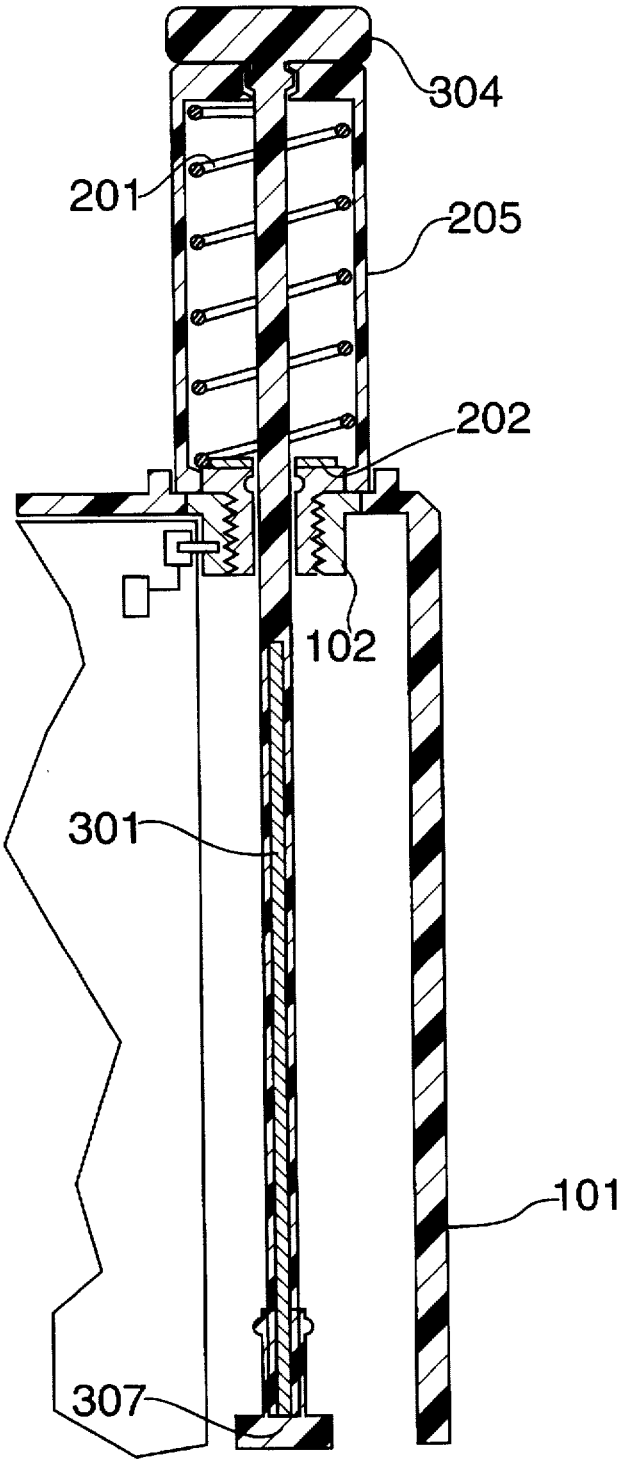
FIG. 2B PRIOR ART
FIG. 2B shows another conventional antenna assembly in a retracted position.
Figure 3A:
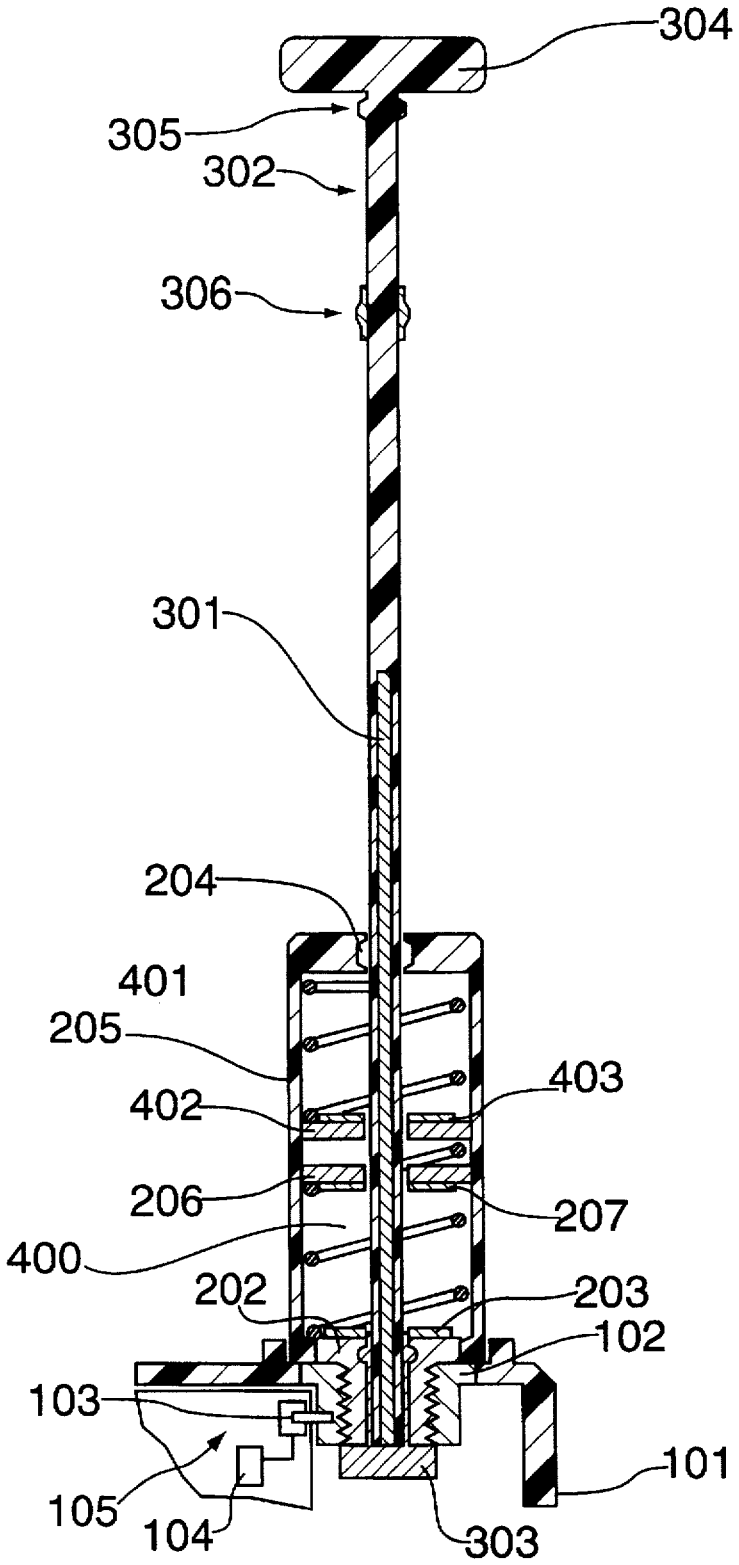
FIG. 3A shows a first embodiment of an antenna assembly in an extended position according to the present invention.
Figure 3B:
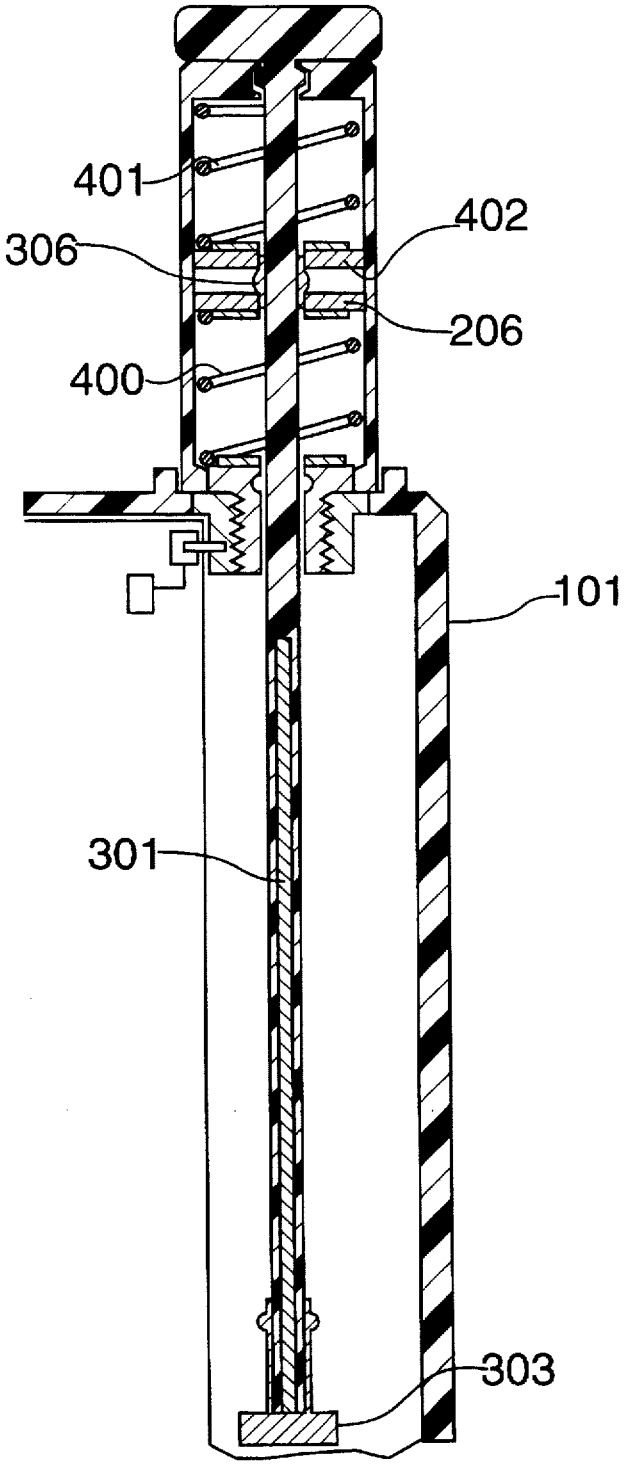
FIG. 3B shows a first embodiment of an antenna assembly in a retracted position according to the present invention.

FIGS. 3A and 3B show a first preferred embodiment of an antenna assembly according to the present invention. FIGS. 3A and 3B show such an antenna assembly in an extended position and a retracted position, respectively. For assembly components similar to those in the conventional antenna assembly shown in FIGS. 1A to 2B, the same reference numerals are put and a detail explanation thereof will be omitted.

As shown in FIGS. 3A and 3B, the antenna assembly has a fixed antenna part including a helical antenna and a movable antenna part including a rod antenna. Similar to the conventional antenna assembly, the movable antenna part of the antenna assembly shown in FIGS. 3A and 3B comprises rod antenna 301 which is a monopole antenna, antenna cover 302 for covering rod antenna 301 and preventing a human body from touching rod antenna 301, and metal stopper 303 attached to the lower end of rod antenna 301. Knob 304 for retracting and extending the movable antenna part is provided at the upper end of antenna cover 302. Knob 304 is also effective in preventing the movable antenna part from falling into housing 101. Second snap-in protrusion 305 is provided right below knob 304 of antenna cover 302 to engage second snap-in recess 204 when the antenna assembly is in the retracted position as shown in FIG. 3B. In addition, the movable antenna part has metal fitting 306 formed on antenna cover 302. The function of metal fitting 306 will be explained later.

Unlike the conventional antenna assembly, the antenna assembly shown in FIGS. 3A and 3B has a helical antenna which is divided into first helical antenna 400 and second helical antenna 401. The lower end of first helical antenna 400 is attached to metal fitting 202 by metal fitting 203. Therefore, first helical antenna 400 is always electrically powered by power supply circuit 104 through antenna clip 103 and metal fittings 203, 202, 102. On the upper end of first helical antenna 400, first electrode 206 is attached by metal fitting 207. Similarly, second electrode 402 is attached onto the lower end of second helical antenna 401 by metal fitting 403.

When the antenna assembly is in the extended position as shown in FIG. 3A, rod antenna 301 extends through the inside of first and second helical antennas 400 and 401. In this extended position, first electrode 206 and second electrode 402 are physically separated so that there is no electrical connection between them. Therefore, second helical antenna 401 is not electrically connected to first helical antenna 402. Accordingly, even though first helical antenna portion is always powered by power supply circuit 104, second helical antenna 401 is not powered when the antenna assembly is in the extended position. Rod antenna 301 is also powered through metal stopper 303 which contacts metal fittings 102 and 202. In this state, rod antenna 301 mainly operates as a monopole antenna which has its ground level at the ground of a shielding case inside housing 101 of the mobile radio unit and the ground of circuit board 105. Although first helical antenna 400 is also powered, it is operable as an accessory of rod antenna 301.

When the antenna assembly is in the retracted position as shown in FIG. 3B, metal fitting 306 fits in between first electrode 206 and second electrode 402 so that metal fitting 306 electrically connects the two electrodes. Therefore, first helical antenna 400 and second helical antenna 401 are now electrically connected. In this state, first helical antenna 400 and second helical antenna 401 are operable as a single helical antenna which has its ground level at the ground of the shielding case inside housing 101 of the mobile radio unit and the ground of circuit board 105.

As explained above, when the antenna assembly is in the extended position as shown in FIG. 3A, there is no electrical connection between first helical antenna 400 and second helical antenna 401. Rod antenna 301 and first helical antenna 400 only are powered in the extended position while second helical antenna 401 is not powered. Therefore, the undesirable resonance in the extended position is produced by the coupling between first helical antenna 400 and rod antenna 301. Second helical antenna 401 has little effect on the undesirable resonance. Therefore, by designing the antenna parameter of first helical antenna 401, the undesirable resonance frequency can be moved away from the required frequency band such as 1.9 Ghz. At the same time, by designing second helical antenna 401, the total performance of the helical antenna including the first and second helical antennas can be also optimized.

For the simplification of the explanation, let us assume that a helical antenna having 10 turns produces the best performance in the retracted position. Further suppose that this helical antenna having 10 turns produces undesirable resonance within the required frequency band in the extended position. If the turn number of the helical antenna need to be changed to move the undesirable resonance frequency out of the required frequency, that change also affects the antenna performance in the retracted position. This is because the helical antenna is made of one-piece.

However, in the antenna assembly in accordance with the present invention, as shown in FIGS. 3A and 3B, a helical antenna is divided into two helical antennas 400 and 401. The two helical antennas are electrically connected and operate as a single helical antenna in the retracted position. As long as the total number of the turns of the two helical antennas remain unchanged, the antenna performance in the retracted position can be maintained.

At the same time, by changing the combination of the turns of the two helical antennas such as (5,5), (6,4), (7,3) and so on, the frequency of the undesirable resonance can be controlled. By dividing a helical antenna into two helical antennas which are electrically separated in the extended position but electrically connected in the retracted position, flexibility in designing the antenna parameters is increased so that the best antenna performance can be achieved both in the extended position and retracted position. The impedance characteristics in extended position can be also adjusted without changing the impedance characteristics in retracted position.

Although a helical antenna is divided into two helical antennas in this particular embodiment, it can be divided into more helical antennas.

Figure 4A:
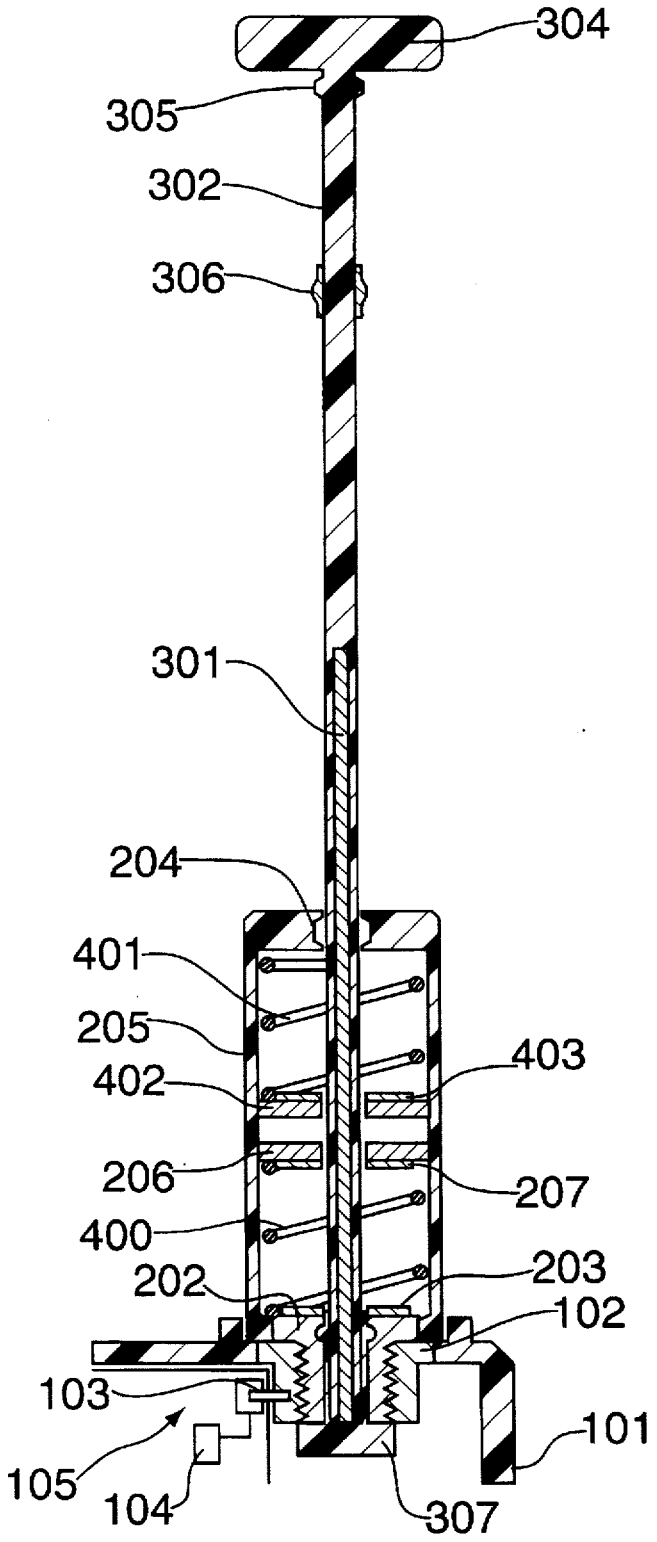
FIG. 4A shows a second embodiment of an antenna assembly in an extended position according to the present invention.
Figure 4B:
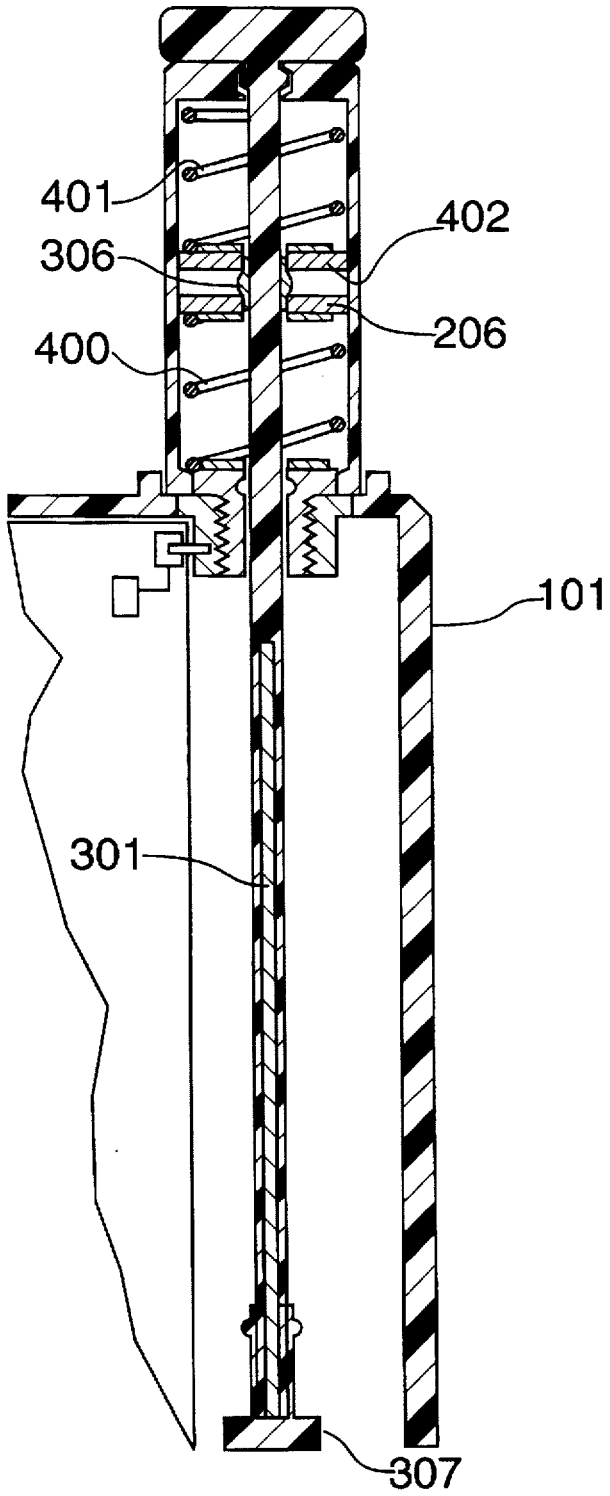
FIG. 4B shows a second embodiment of an antenna assembly in a retracted position according to the present invention.

FIGS. 4A and 4B show another preferred embodiment of an antenna assembly in accordance with the present invention. FIGS. 4A and 4B show such an antenna assembly in an extended position and in a retracted position, respectively. Similar to the antenna assembly shown in FIGS. 3A and 3B, a helical antenna is divided into first helical antenna 400 and second helical antenna 401. First helical antenna 400 and second helical antenna 401 are electrically separated in the extended position, but electrically connected in the retracted position. The difference between the antenna assembly shown in FIGS. 3A and 3B and the antenna assembly shown in FIGS. 4A and 4B is a stopper attached to the lower end of rod antenna 301. Unlike metal stopper 301 as shown in FIGS. 3A and 3B, insulator stopper 307 is used in the antenna assembly shown in FIGS. 4A and 4B.

In the extended position where insulator stopper 307 contacts metal fittings 102 and 202, there is no electrical connection between first helical antenna 400 and rod antenna 301 because insulator stopper 307 exists therebetween. Nevertheless, rod antenna 301 is powered by electromagnetical coupling between first helical antenna 400 and rod antenna 301. As a result, in the extended position, rod antenna 301 mainly operates as a monopole antenna which has its ground level at the ground of the shielding case inside housing 101 of the mobile radio unit and the ground of circuit board 105. Although first helical antenna 400 is also powered, it is operable as an accessory of rod antenna 301.

Since a helical antenna is divided into first helical antenna 400 and second helical antenna 401 which are electrically separated in the extended position, but electrically connected in the retracted position, optimization of the helical antenna in the retracted position and avoiding the undesirable resonance within the required frequency band can be achieved simultaneously.

Figure 5A:
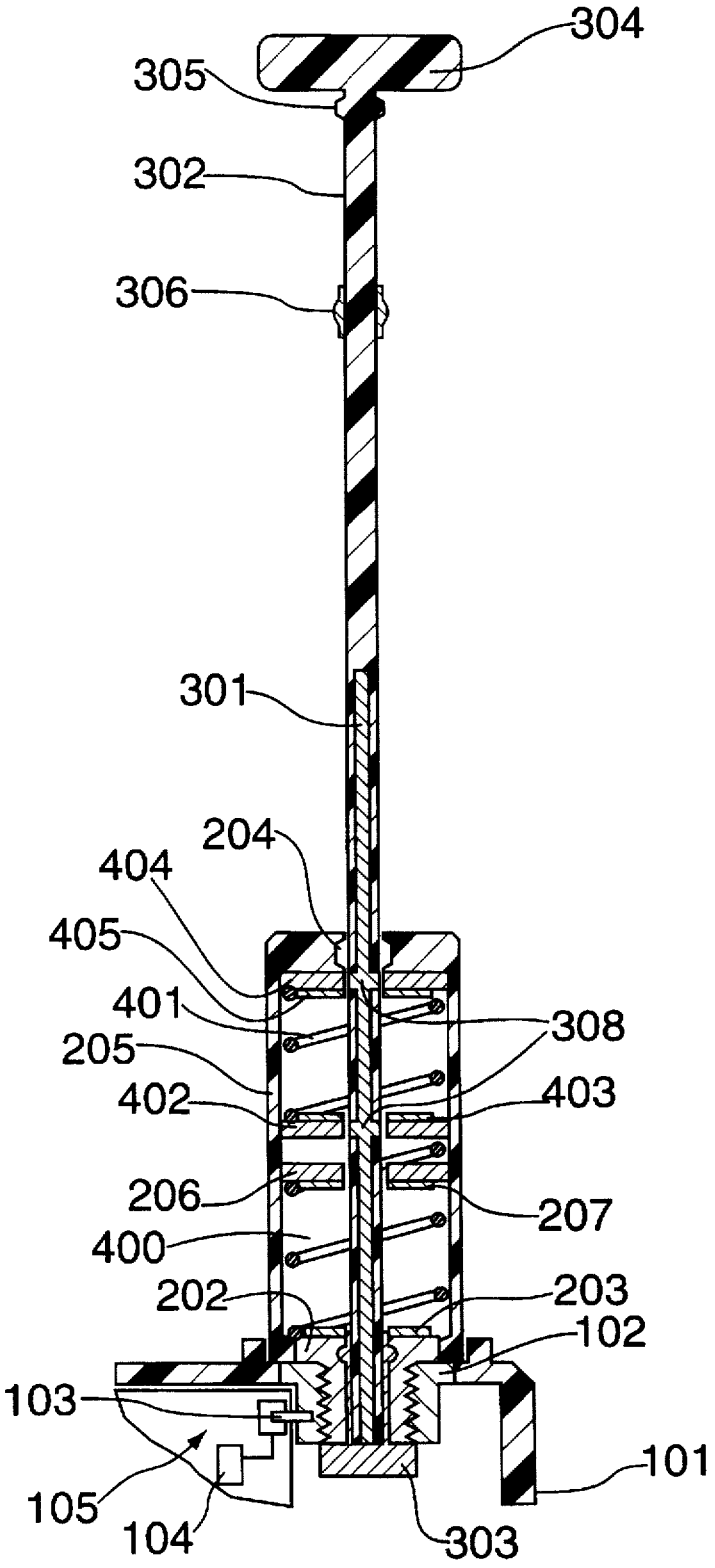
FIG. 5A shows a third embodiment of an antenna assembly in an extended position according to the present invention.
Figure 5B:
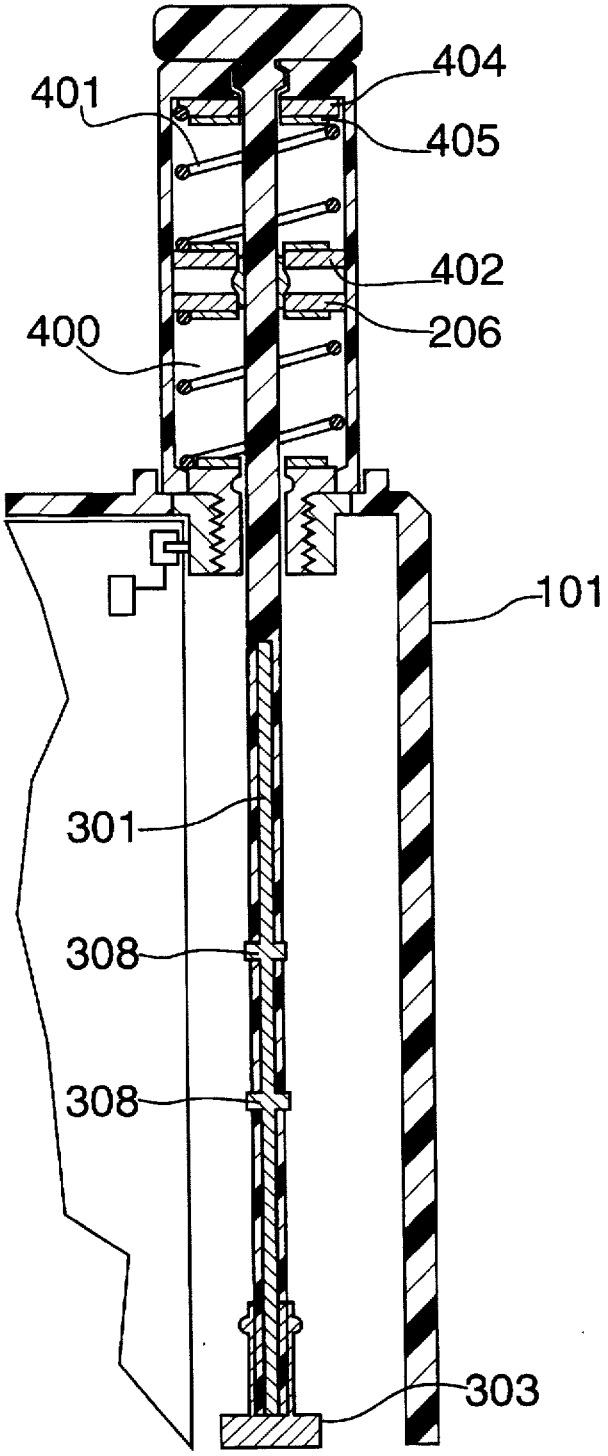
FIG. 5B shows a third embodiment of an antenna assembly in a retracted position according to the present invention.

FIGS. 5A and 5B show a third preferred embodiment of an antenna assembly in accordance with the present invention. FIGS. 5A and 5B show such an antenna assembly in an extended position and in a retracted position, respectively. Similar to the antenna assembly shown in FIGS. 3A and 3B, a helical antenna is divided into first helical antenna 400 and second helical antenna 401. First helical antenna 400 and second helical antenna 401 are electrically separated in the extended position, but electrically connected in the retracted position.

As shown in Figs.5A and 5B, there is provided third electrode 404 in addition to first electrode 206 and second electrode 402. Third electrode 404 is attached on the upper end of second helical antenna 401 by metal fitting 405. Rod antenna 301 has protruding portions 308 and 308 which are exposed to the surface of antenna cover 302. Even though protruding portions 308 and 308 are not covered by antenna cover 302, they cannot be touched by the human body because they are always inside antenna cover 205 or housing 101. In the extended position, as shown in FIG. 5A, second helical antenna 401 is shorted by protruding portions 308 and 308 formed on rod antenna 301. Therefore, undesirable radiation by second antenna 401 can be suppressed.

Figure 6A:
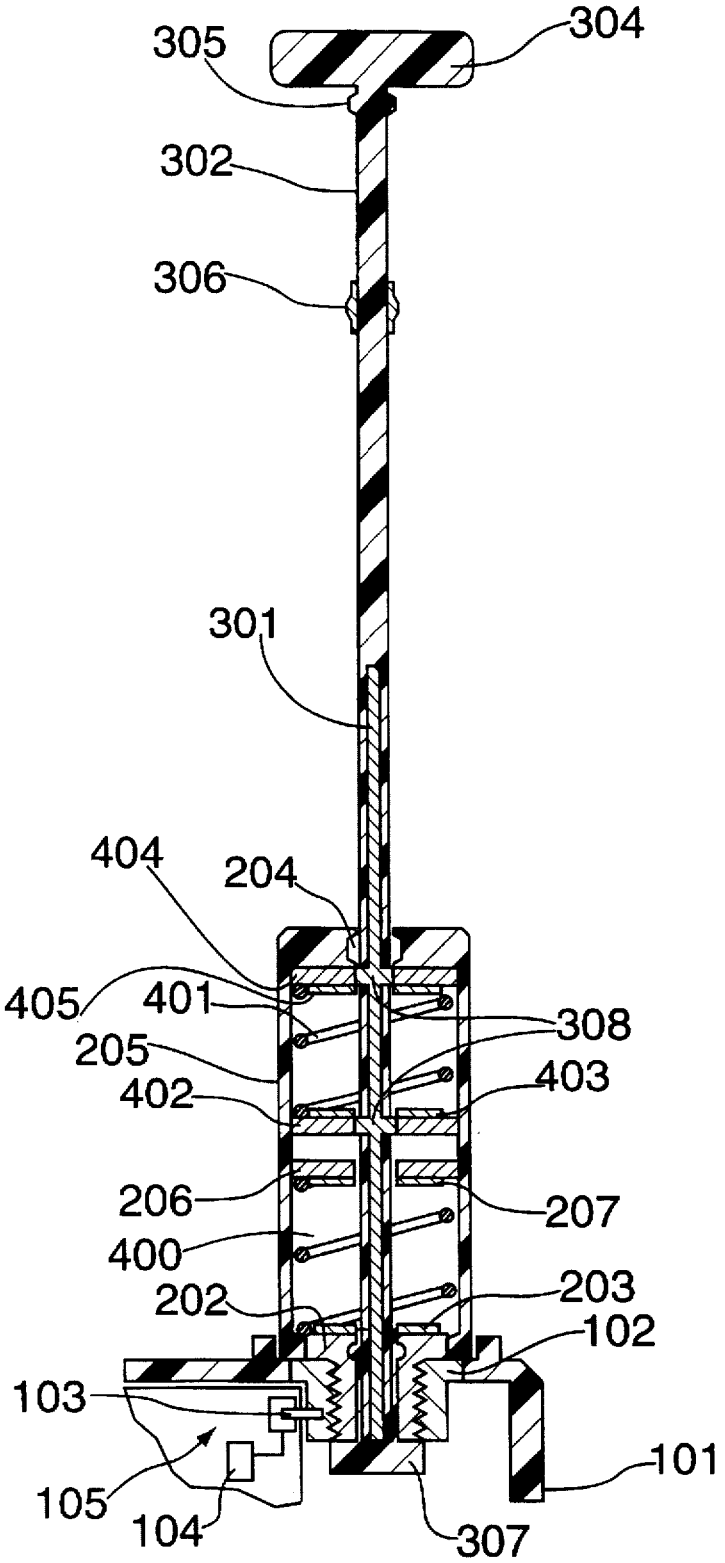
FIG. 6A shows a fourth embodiment of an antenna assembly in an extended position according to the present invention.
Figure 6B:
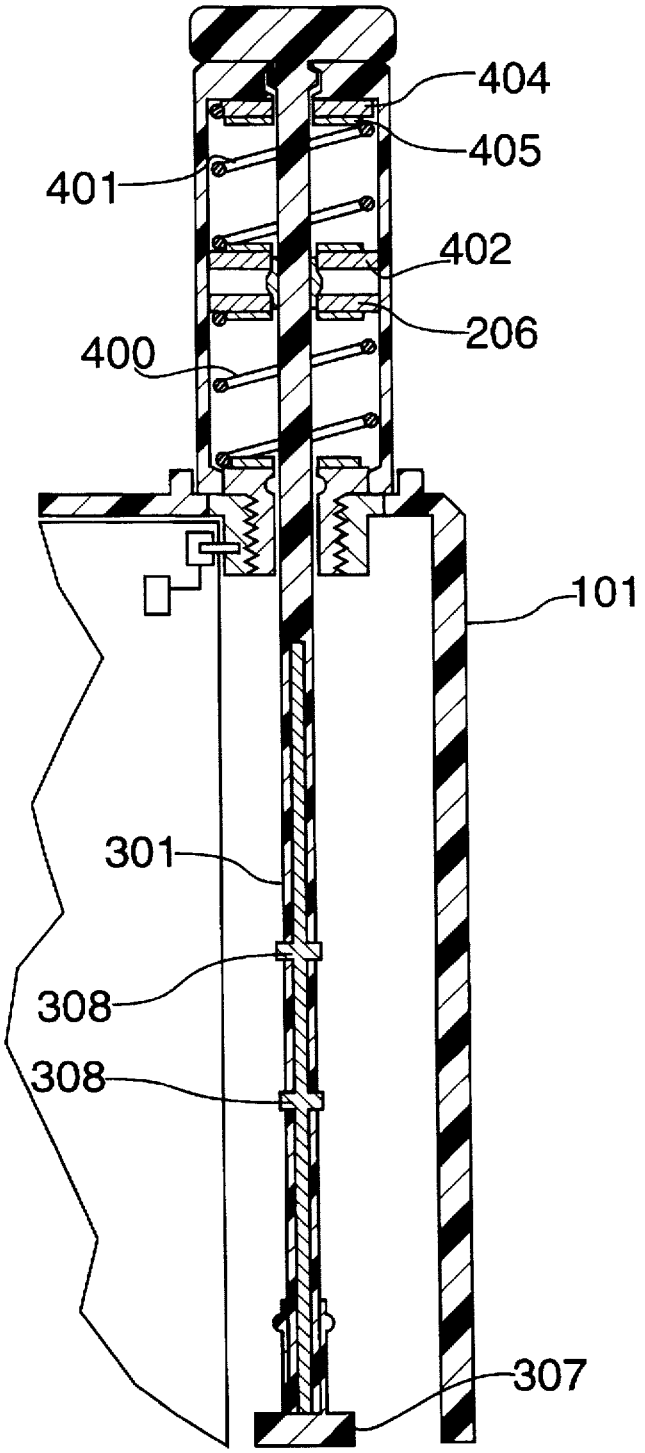
FIG. 6B shows a fourth embodiment of an antenna assembly in a retracted position according to the present invention.

FIGS. 6A and 6B show a fourth preferred embodiment of an antenna assembly in accordance with the present invention. FIGS. 6A and 6B show such an antenna assembly in an extended position and in a retracted position, respectively. Similar to the antenna assembly shown in FIGS. 5A and 5B, a helical antenna is divided into first helical antenna 400 and second helical antenna 401. Third electrode 404 is also attached on the upper end of second helical antenna 401 by metal fitting 405. Rod antenna 301 has protruding portions 308 and 308 which are exposed to the surface of antenna cover 302. With this structure, second helical antenna 401 is shorted by protruding portions 308 and 308 when the antenna assembly is in the extended position. Therefore, undesirable radiation by second antenna 401 can be suppressed.

The difference between the antenna assembly shown in FIGS. 5A and 5B and the antenna assembly shown in FIGS. 6A and 6B is a stopper attached to the lower end of rod antenna 301. Unlike metal stopper 301 as shown in FIGS. 5A and 5B, insulator stopper 307 is used in the antenna assembly shown in FIGS. 4A and 4B.

In the extended position where insulator stopper 307 contacts metal fittings 102 and 202, there is no electrical connection between first helical antenna 400 and rod antenna 301 because insulator stopper 307 exists therebetween. Nevertheless, rod antenna 301 is powered by electromagnetical coupling between first helical antenna 400 and rod antenna 301. As a result, in the extended position, rod antenna 301 mainly operates as a monopole antenna which has its ground level at the ground of the shielding case inside housing 101 of the mobile radio unit and the ground of circuit board 105. Although first helical antenna 400 is also powered, it is operable as an accessory of rod antenna 301.

In the fourth embodiment of the antenna assembly shown in FIGS. 6A and 6B, since a helical antenna is divided into first helical antenna 400 and second helical antenna 401 which are electrically separated in the extended position but electrically connected in the retracted position, optimization of the helical antenna in the retracted position and avoiding the undesirable resonance within the required frequency band can be achieved simultaneously.

Furthermore, since second helical antenna 401 is shorted by protruding portions 308 and 308 in the extended position, undesirable radiation by second antenna 401 can be suppressed.

Though an antenna assembly in accordance with the present invention has been explained with four specific embodiments, it is to be understood that numerous changes and modifications may be made by those skilled in the art without departing from the scope of the present invention.

What is claimed is:

1. An antenna assembly comprising:

a rod antenna movable between a retracted position and an extended position;

a helical antenna having a first helical portion and a second helical portion which are electrically separated from each other, wherein said rod antenna extends through the inside of said first and second portions of said helical antenna when said rod antenna is in said extended position and wherein said rod antenna is removed from the inside of said helical antenna when said rod antenna is in said retracted position; and connecting means for electrically connecting said first helical portion and said second helical portion when said rod antenna is in said retracted position so that said first helical portion and said second helical portion become operable as a single helical antenna.

2. The antenna assembly according to claim 1, wherein said connecting means is movable with said rod antenna in the axial direction thereof.

3. The antenna assembly according to claim 2, further comprising a first antenna cover for covering said rod antenna so that said rod antenna cannot be directly touched from outside, wherein said first antenna cover is movable with said rod antenna, and a second antenna cover for covering said helical antenna so that said helical antenna cannot be directly touched from outside, wherein said second antenna cover is not movable.

4.The antenna assembly according to claim 2, wherein said connecting means is a metal piece attached to said first antenna cover.

5. The antenna assembly according to claim 1, further comprising shorting means for shorting both ends of at least one of said first and second helical portions when said rod antenna is in said extended position.

6. An antenna assembly comprising:

a rod antenna movable between a retracted position and an extended position;

a helical antenna having a plurality of helical portions which are electrically separated from one another, wherein said rod antenna extends through the inside of said plurality of helica portions of said helical antenna when said rod antenna is in said extended position and wherein said rod antenna is removed from the inside of said helical antenna when said rod antenna is in said retracted position; and connecting means for electrically connecting said plurality of helical portions when said rod antenna is in said retracted position so that said plurality of helical portions become operable as a single helical antenna.

7. The antenna assembly according to claim 6, wherein said connecting means is movable with said rod antenna in the axial direction thereof.

8. The antenna assembly according to claim 7, further comprising a first antenna cover for covering said rod antenna so that said rod antenna cannot be directly touched from outside, wherein said first antenna cover is movable with said rod antenna, and a second antenna cover for covering said helical antenna so that said helical antenna cannot be directly touched from outside, wherein said second antenna cover is not movable.

9. The antenna assembly according to claim 7, wherein said connecting means is a metal piece attached to said first antenna cover.

10. The antenna assembly according to claim 6, further comprising shorting means for shorting both ends of at least one of said plurality of helical portions when said rod antenna is in said extended position.

11. An antenna assembly comprising:

a rod antenna movable between a retracted position and an extended position;

a helical antenna having a plurality of helical portions which are electrically separated from one another, one of said plurality of helical portions being always electrically powered, wherein said rod antenna extends through the inside of said helical antenna when said rod antenna is in said extended position and wherein said rod antenna is removed from the inside of said helical antenna when said rod antenna is in said retracted position;

first connecting means for electrically connecting said plurality of helical portions when said rod antenna is in said retracted position so that said plurality of helical portions are electrically powered and become operable as a single helical antenna; and second connecting means for electrically connecting said rod antenna to said one of plurality of helical portions which is always electrically powered when said rod antenna is in said extended position.

* * * * *